US005095821A

United States Patent [19]

Merz

[11] Patent Number: 5,095,821

[45] Date of Patent: Mar. 17, 1992

[54] FRAGMENTATION CASING AND METHOD OF MAKING

[75] Inventor: Karl Merz, Reinach, Switzerland

[73] Assignee: HUG Interlizenz AG, Zurich, Switzerland

[21] Appl. No.: 381,747

[22] PCT Filed: Sep. 9, 1988

[86] PCT No.: PCT/CH88/00157

§ 371 Date: Jun. 14, 1989

§ 102(e) Date: Jun. 14, 1989

[87] PCT Pub. No.: WO89/03500

PCT Pub. Date: Apr. 20, 1989

[30] Foreign Application Priority Data

Oct. 14, 1987 [CH] Switzerland ..... 4023/87

[51] Int. Cl.[5] ..... F42B 12/24; B21K 21/06

[52] U.S. Cl. ..... 102/493; 102/389; 29/1.21; 219/121.69

[58] Field of Search ..... 102/389, 474, 476, 491, 102/493, 494, 495; 219/121.39, 121.67, 121.68, 121.69; 29/1.2, 1.21, 416; 228/57, 170, 196

[56] References Cited

U.S. PATENT DOCUMENTS

| | | | |
|---|---|---|---|
| 1,203,062 | 10/1916 | Semple | 102/389 |
| 2,382,277 | 8/1945 | Whitesell, Jr. | 102/389 |
| 2,393,275 | 1/1946 | Whitesell, Jr. | 102/491 |
| 2,458,576 | 1/1949 | Etten | 102/389 |
| 2,673,730 | 3/1954 | Hupp . | |
| 2,798,431 | 7/1957 | Semon et al. | 102/495 |
| 3,434,422 | 3/1969 | Herman et al. | 29/1.21 |
| 3,768,414 | 10/1973 | Polcha . | |
| 3,855,933 | 12/1974 | Messineo . | |
| 4,398,467 | 8/1983 | Leigh | 102/491 |
| 4,456,705 | 10/1985 | Langenohl et al. | 102/520 |
| 4,570,318 | 2/1986 | Kish | 29/173 |
| 4,590,652 | 5/1986 | Harwood | 228/170 |
| 4,770,100 | 9/1988 | Gunthner et al. | 102/476 |

FOREIGN PATENT DOCUMENTS

| | | | |
|---|---|---|---|
| 0030809 | 11/1984 | European Pat. Off. . | |
| 2837638 | 3/1979 | Fed. Rep. of Germany | 102/491 |
| 3221565 | 12/1982 | Fed. Rep. of Germany . | |
| 8427781.5 | 5/1985 | Fed. Rep. of Germany . | |
| 8427962.1 | 5/1985 | Fed. Rep. of Germany . | |
| 3624330 | 9/1987 | Fed. Rep. of Germany . | |
| 792362 | 10/1935 | France . | |
| 2312009 | 12/1976 | France | 102/491 |
| 2402003 | 3/1979 | France . | |
| 675475 | 12/1987 | Switzerland . | |

OTHER PUBLICATIONS

U.S. Statutory Invention Registration H238, Mar. 3, 1987, Adams.

*Primary Examiner*—Harold J. Tudor

*Attorney, Agent, or Firm*—Tarolli, Sundheim & Covell

[57] ABSTRACT

The fragmentation casing has a one-piece hollow body (1) that incorporates nominal break points; this hollow body (1) is divided at least in one section (4) by at least one separating cut (5) that forms a separating gap. The separating cut is so made that the hollow body remains in the form of a one-piece structure. The surfaces of the separating cut that are adjacent in the separating gap are brought into contact with each other and are so fixed in contact with each other.

19 Claims, 4 Drawing Sheets

FRAGMENTATION CASING AND METHOD OF MAKING

TECHNICAL DOMAIN

The present invention relates to a fragmentation casing for an explosive device, in particular for a projectile, a grenade, or a mine, with a one-piece hollow body that incorporates nominal break points. In addition, the present invention relates to a process for the production of such a fragmentation casing.

PRIOR ART

It is known that projectiles, grenades, or mines can be fitted with a fragmentation casing that is configured as a hollow body that contains an explosive bursting charge and which, on detonation, is intended to shatter into the greatest possible number of fragments. In order to facilitate this fragmentation, the fragmentation casing usually incorporates nominal break points If, however, these nominal break points are in the form of grooves in the fragmentation casing, some of the potential total mass of the fragmentation casing (in relation to its size) is lost. The following methods, amongst others, have been used in order to avoid this mass decrement, at least in part:

In order to produce a fragmentation casing, wire of square cross-section, as well as with previously made notches transverse to its longitudinal axis on one (EP-B1-0 030 809) or two (US-H238) sides has been wound into a spiral such that the coils so formed were closely adjacent, so that there was no gap between them and no mass was lost. The coils were then joined to each other by soldering (EP-B1-0 030 809) or by laser welding (US-H328). DE-OS 32 21 ,565 also describes a spiral fragmentation casing. DE-U1-84 27 962.1 describes a fragmentation casing that consists of rings of rectangular cross-section that are arranged on a supporting body instead of being closely adjacent. DE-U1-84 27 781.5 describes a warhead with cracks in the warhead housing that result from grooves machined into the wall of the warhead housing, by upsetting the warhead housing.

However, the production of all the above types of fragmentation housings, in particular those with rings, is extremely costly.

DESCRIPTION OF THE INVENTION

It is the task of the present invention to describe a fragmentation casing of the type described heretofore, it being possible to produce this with far less labour and in a more rational manner.

According to the present invention, this task has been solved by a fragmentation housing having the distinguishing features set forth below. The underlying concept of this solution is that the hollow body is slit in at least one section by at least one separating cut that forms a separating gap, the separating cut being so made that the hollow body remains as a one-piece structure. The surfaces of the separating cut that are adjacent in the separating gap are brought into contact with each other and then fixed when in contact with each other.

Advantageous and preferred embodiments of the present invention are set forth below.

Additionally, it is the task of the present invention to describe a process that is particularly suitable for the production of such a fragmentation housing.

This task has been solved by a process as described below.

BRIEF DESCRIPTION OF THE DRAWINGS

The invention is described below on the basis of examples shown in the drawings appended hereto These drawings show the following.

METHODS OF REDUCING THE INVENTION TO PRACTICE

Figure 1:
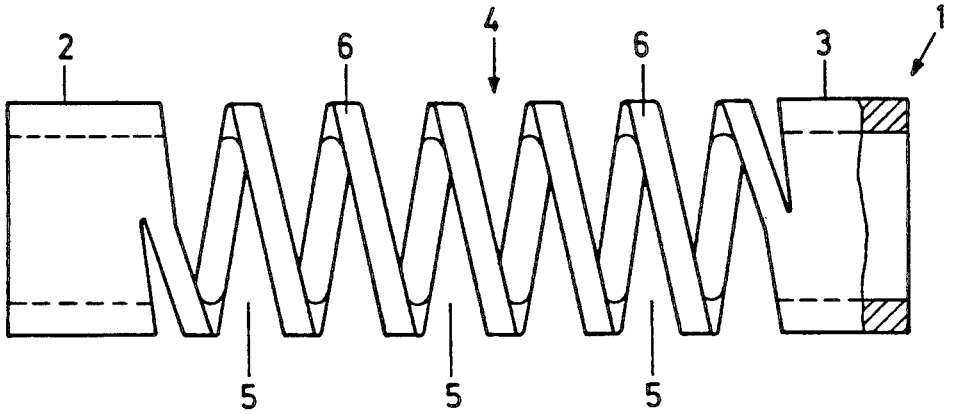
FIG. 1: A hollow body in the form of a hollow cylinder, the casing of which is divided equally into coils between two end sections by a separating cut, said coils being spaced by being drawn apart from each other.

In the drawings, the invention will be described on the basis of a hollow cylinder 1 as a hollow body. This hollow cylinder is produced from a metallic material, for example, heat-treated steel. Reference is first made to FIG. 1. The hollow cylinder 1 shown therein is of a constant wall thickness. There is a helical separating cut 5 in the center section 4 that is located between the two end sections 2, 3, the center section 4 being formed into coils 6 thereby. This separating cut 5 is produced by a metal-cutting apparatus, for example, a laser or a plasma cutting system. The separating cut 5 can also be produced by other means, for example, by a mechanical cutting system. In FIG. 1, the gap that is formed between the coils is shown enlarged as a result of the coils 6 having been drawn apart. In actual fact, the width of the gap produced when the separating cut is made by a laser cutting system is only approximately 0.15 to 0.3 mm.

Figure 2:
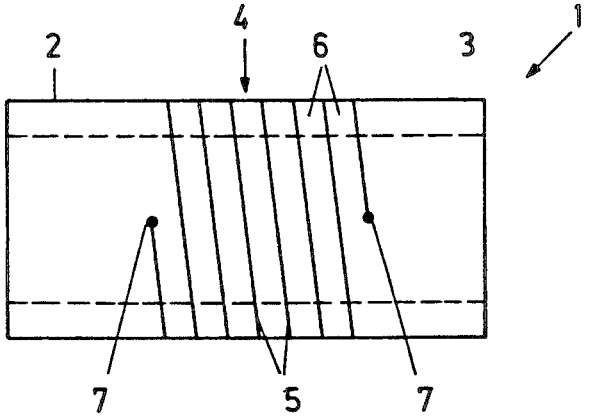
FIG. 2: A hollow body as in FIG. 1, this being compressed, however, so that the coils rest against each other.

Despite the small gap width that can be achieved, the mass decrement associated therewith is considered undesirable. This mass decrement can, however, be eliminated very simply by compressing the cylinder 1. FIG. 2 shows the hollow cylinder as in FIG. 1, albeit with the coils 6 compressed so that they abut closely against one another, thereby producing a continuous, compact, hollow cylinder.

In order to facilitate this compression at the two ends of the separating cut as well, a small hole 7 of at least approximately circular cross-section can be produced at each end.

Figure 3:
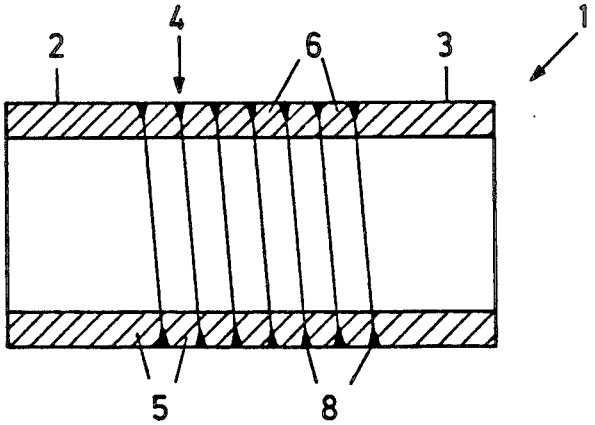
FIG. 3: A cross-section through a hollow body as in FIG. 2, in which, however, the adjacent edges of the separating cut are partially joined to each other by welding on the outer periphery.
Figure 5:
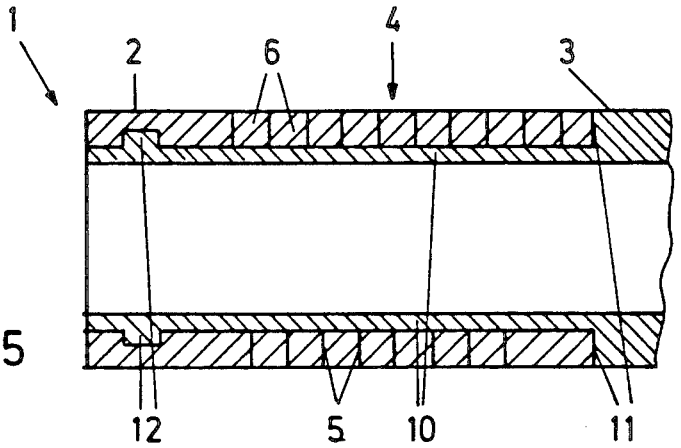
FIG. 5: A cross-section through a hollow body as in FIG. 2, but with a supporting sleeve inserted therein.

In the compressed state, the hollow cylinder 1 is under a certain amount of elastic tension. In order that it remain thus, it has to be fixed in this state. This can be effected in a very simple manner by welding adjacent edges of the separating cut 5 together, as is shown in FIG. 5. In FIG. 3, a welded seam on the outside periphery, which extends continuously along the separating cut, is numbered 8.

FIG. 3 shows an embodiment of the invention in which the edges of the separating cut 5 are discontinuous welded along the separating cut, on the outside periphery. The individual discontinuous welds are numbered 9.

In principle, it is possible, albeit more difficult from the technical standpoint, to make such welds on the inside, either as an alternative or in addition to welds made on the outside.

A body that is stable per se can be produced from the hollow cylinder that has been intersected by the separating cut by the welds made on the edges of the separating cut, and such a body is immediately suitable for accommodating an explosive charge, without needing any additional reinforcing or strengthening elements.

Another possible way of fixing the hollow cylinder in the compressed state is by using a supporting sleeve. FIG. 5 illustrates the incorporation of an interior supporting sleeve. In the right-hand part of FIG. 5, the hollow cylinder 1 is fixed at one end by a shoulder 11 of the supporting sleeve 10, which extends outwards; the left-hand part of FIG. 5 shows the other end fixed by a rim on the supporting sleeve 10 that fits in an inside groove 12 in the hollow cylinder. It is preferred that the supporting sleeve 10 be of a metal that is relatively amenable to shaping, such as aluminum, and is press fitted into the hollow cylinder (whereby the metal flows into the groove in the hollow cylinder). The supporting sleeve can also be in the form of an external sleeve (not shown herein).

The stability of the hollow cylinder 10 is greatly enhanced by the supporting sleeve 10. However, the supporting sleeve 10 requires a certain volume, by which the volume of the explosive charge that is to be contained within the cylinder must be reduced. For this reason, the solution that involves welding is to be preferred in regard to the optimal relationship between the size of the explosive charge and the total mass of the explosive device.

Figure 6:
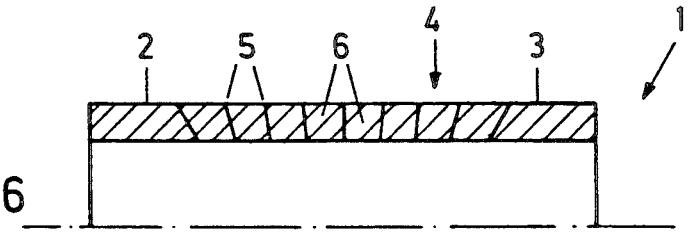
FIG. 6: A cross-section of a hollow body, only half of which is shown, in which, however, the separating cut is for the most part inclined at an oblique angle to its surface.

FIG. 6 is a half cross-section of a hollow body as in FIG. 2; in this example, however, the separating cut is for the most part made at an obtuse angle to the surface of the hollow body. This makes it possible, for example, to take into account the manner in which the shock wave, generated when the explosive charge is detonated, is distributed in space.

Figure 7:
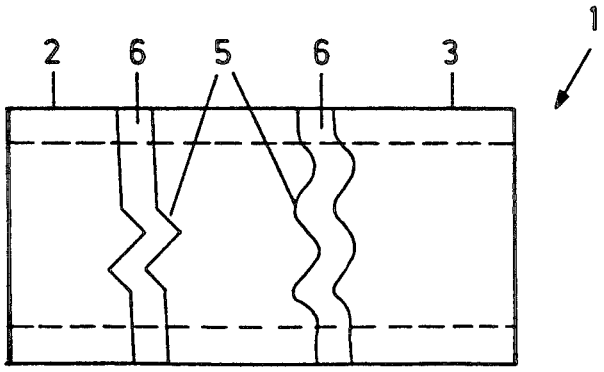
FIG. 7: A hollow body as in FIG. 2, in which, however, sections of the separating cut are in a zig-zag form.

FIG. 7 shows a hollow body as in FIG. 2, in which however, the separating cut 5 is in the form of zig-zag or serpentine sections. Meshing of the individual coils 6 with each other, which increases the stability of the hollow body, is achieved by such a configuration of the separating cut 5.

Figure 8:
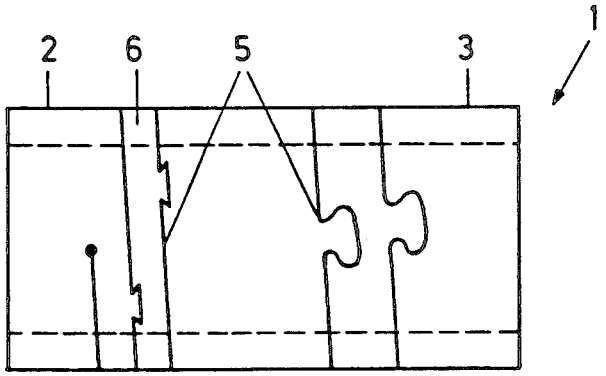
FIG. 8: A hollow body as in FIG. 2, in which, however, the separating cut is formed so as to produce an interlocking effect.

The same applies to the embodiment shown in FIG. 8, in which the separating cut 5 is made in sections such that the areas of the hollow body 1 that are located on both sides of the separating cut are additionally interlocked with each other.

Figure 9:
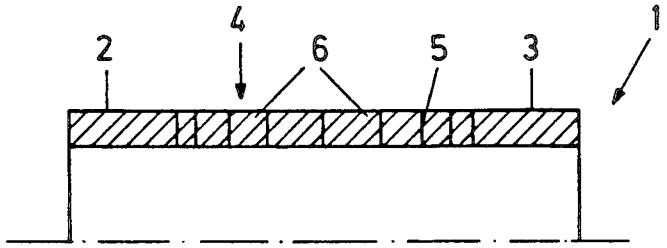
FIG. 9: A cross-section of a hollow body as in FIG. 2, only half of which is shown, in which, however, the spacing of the coils is not constant.

FIG. 9 is a half cross-section of a hollow body as in FIG. 2; in this example, however, the pitch of the coils 6 is not constant, but decreases from the middle 4 towards each end (towards the end sections 2, 3). This, too, makes it possible to take into account the manner in which the shock wave, generated when the explosive charge is detonated, is distributed in space.

Figure 4:
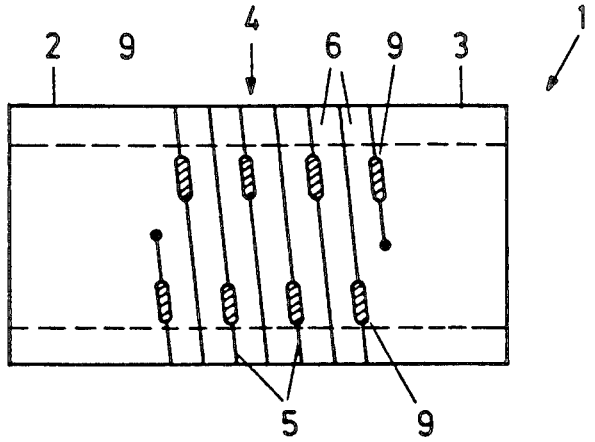
FIG. 4: A hollow body as in FIG. 2, but in which the adjacent edges of the separating cut are partially connected to each other by discontinuous welding on the outer periphery.
Figure 10:
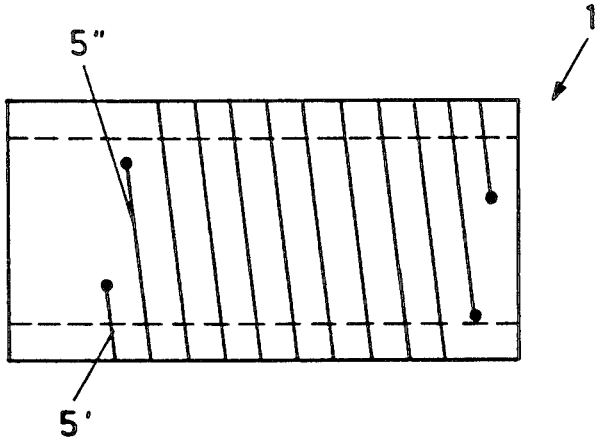
FIG. 10: A hollow body as in FIG. 2, in which, however, there are two separating cuts.

Even though only one separating cut is to be preferred, it is of course possible to incorporate a plurality of such separating cuts. FIG. 10 shows a hollow body 1 as in FIG. 2, in which two helical separating cuts 5, 5', which do not intersect, have been made. In addition, the separating cuts can be so made as to be interrupted instead of being welded (8 or 9 in FIGS. 3 or 4, respectively).

Figure 11:
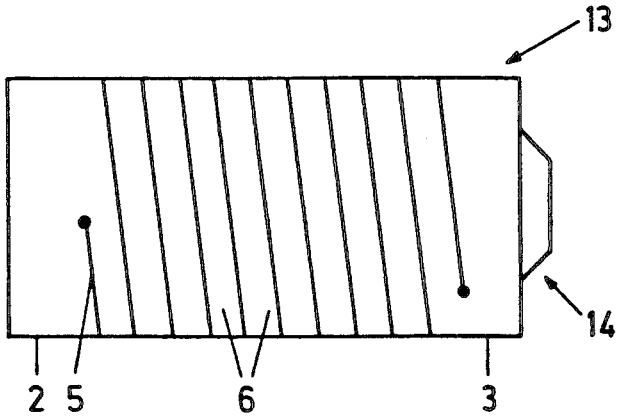
FIG. 11: A hollow body as in FIG. 2, in which, however, there is a blocked-on detonator head.

FIG. 11 shows a fragmentation casing that is configured as a predominantly cylindrical sleeve 13 with a base 14 that is formed as an attachment element for a detonator head. Such a hollow body is produced by hot and/or cold massive forming or by a drawing and ironing process prior to the production of the separating cut, when the attachment element for the detonator head is blocked out at the same time. The separating cut 5 ends or begins a short distance from the opening at the left-hand side of the sleeve, on the one hand, and from its base 14, on the other.

Figure 12:
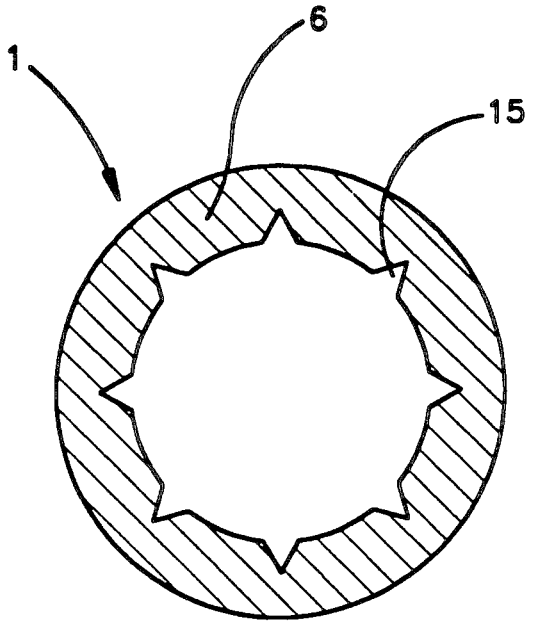
FIGS. 12 and 13: Cross-sections through hollow bodies in the form of hollow cylinders, on the inner or outer walls of which there are grooves that extend axially, to form nominal break points.
Figure 13:
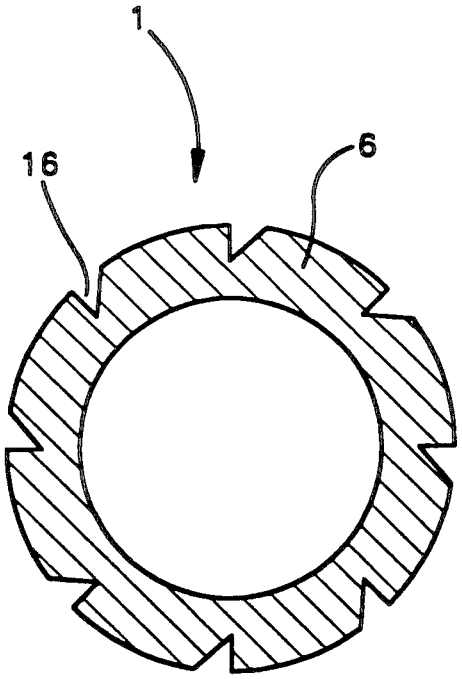

FIGS. 12 and 13 show cross-sections of hollow bodies in the form of hollow cylinders, in the inner or outer walls of which there are axial grooves 15 or 16 that taper to points, these grooves acting as nominal break points. If the above production techniques cited heretofore are used, the grooves can be formed at the same time. Instead of extending axially, the grooves can also extend helically, for example. Generally speaking, they should be substantially perpendicular to the separating cuts.

The embodiment of the hollow body is in no way confined to the form of a hollow cylinder. The invention can be applied without any problem to conical, truncated conical, spherical, ovoid, plate-shaped, or grenade-shaped hollow bodies, with one embodiment being possible with or without a supporting sleeve. Hollow bodies that are open at two locations, at only one location or on only one side, or are completely closed can be used.

If the grooves that produce the nominal break points are omitted, the resulting hollow body with its coil section can be used for other purposes, for example, after appropriate heat treatment, as a spring. All materials in which a separating cut can be produced by a suitable process can be used.

I claim:

1. A fragmentation casing for an explosive device, said fragmentation casing comprising a one-piece hollow body (1), said one-piece body having a cylindrical portion (13) and a base portion (14), said cylindrical portion having inner and outer cylindrical surfaces, one of said inner or outer cylindrical surfaces being grooved to provide nominal break points upon explosion of the explosive device, a section of said cylindrical portion having at least one cut defined by first and second opposing surfaces, said cut extending in a substantially helical form along said section, said first opposing surface being substantially in engagement with said second opposing surface, said base portion being disposed at and closing one end of said cylindrical portion, said base portion being configured as an attachment element for a detonator head, and said cut extending to a point on said cylindrical portion located a short distance from said base portion.

2. A fragmentation casing as set forth in claim 1, further comprising means for maintaining said first opposing surface in engagement with said second opposing surface.

3. A fragmentation casing as set forth in claim 2, wherein said means for maintaining includes welding along at least a portion of said cut.

4. A fragmentation casing as set forth in claim 2, wherein said means for maintaining includes a hollow supporting member inserted into said cylindrical portion.

5. A fragmentation casing as set forth in claim 1, wherein said body has at least one open end, said cut extends to a point on said cylindrical portion located a short distance from said open end.

6. A fragmentation casing as set forth in claim 1, wherein an end of said cut extends to a hole that is approximately round in cross-section.

7. A fragmentation casing as set forth in claim 1, wherein the helical form of said cut has a slope which varies.

8. A fragmentation casing as set forth in claim 1, wherein said cut extends such that at least a portion of said first and second opposing surfaces interlock.

9. A fragmentation casing as set forth in claim 1, wherein said cut includes a zig-zag portion.

10. A fragmentation casing as set forth in claim 1, wherein said cut includes a serpentine section.

11. A fragmentation casing as set forth in claim 1, wherein said first and second opposing faces are substantially perpendicular to said inner and outer cylindrical surfaces.

12. A fragmentation casing as set forth in claim 1, wherein a portion of each of said first and second opposing faces is inclined at an obtuse angle to said inner and outer cylindrical surfaces.

13. A fragmentation casing as set forth in claim 1, said section of said cylindrical portion including a plurality of cuts, each of said plurality of cuts being defined by first and second opposing surfaces, each of said cuts extending in a substantially helical form, each of said plurality of cuts being nonintersecting with the other of said plurality of cuts.

14. A method of making a fragmentation casing, said method comprising the steps of:

forming a one-piece hollow body, the hollow body having a cylindrical portion with inner and outer surfaces and a base portion, said base portion being disposed at and closing one end of said cylindrical portion, said base portion being configured as an attachment element for a detonator head;

forming grooves on one of said inner and outer surfaces of the cylindrical portion;

cutting a helical cut defined by first and second opposing surfaces along at least a section of the cylindrical portion; and engaging the first opposing surface to the second opposing surface.

15. A method as set forth in claim 14, wherein said step of cutting is performed with a laser.

16. A method as set fort in claim 14, including the step of attaching a means for maintaining the first opposing surface to the second opposing surface.

17. A method as set forth in claim 16, where said step of attaching a means for maintaining the first opposing surface to the second opposing surface includes welding.

18. A method as set forth in claim 16, wherein said step of attaching a means for maintaining the first opposing surface to the second opposing surface includes inserting a hollow supporting member into the cylindrical portion.

19. A method as set forth in clam 14, wherein said step of forming a one-piece hollow body includes drawing and ironing a material into the shape of the cylindrical portion and the base portion.

* * * * *

UNITED STATES PATENT AND TRADEMARK OFFICE

CERTIFICATE OF CORRECTION

PATENT NO. : 5,095,821
DATED : March 17, 1992
INVENTOR(S) : Karl Merz

It is certified that error appears in the above-identified patent and that said Letters Patent is hereby corrected as shown below:

Title page,
Delete Item [73], "Assignee: HUG Interlizenz AG, Zurich Switzerland". No Assignee should be indicated on the cover page of this patent.

Signed and Sealed this

Twenty-second Day of January, 2002

*Attest:*

*Attesting Officer*

JAMES E. ROGAN
*Director of the United States Patent and Trademark Office*